US010160581B2

(12) United States Patent
Terrasi

(10) Patent No.: US 10,160,581 B2
(45) Date of Patent: Dec. 25, 2018

(54) WRAPPER FOR CONFECTIONARY PRODUCTS

(71) Applicant: SOREMARTEC S.A., Findel (LU)

(72) Inventor: Giuseppe Terrasi, Benevello (IT)

(73) Assignee: SOREMARTEC S.A., Findel (LU)

( * ) Notice: Subject to any disclaimer, the term of this patent is extended or adjusted under 35 U.S.C. 154(b) by 0 days.

(21) Appl. No.: 15/569,945

(22) PCT Filed: Apr. 22, 2016

(86) PCT No.: PCT/IB2016/052304
§ 371 (c)(1),
(2) Date: Oct. 27, 2017

(87) PCT Pub. No.: WO2016/174557
PCT Pub. Date: Nov. 3, 2016

(65) Prior Publication Data

US 2018/0155104 A1 Jun. 7, 2018

(30) Foreign Application Priority Data

Apr. 28, 2015 (IT) ..... 102015000013414

(51) Int. Cl.

| | |
|---|---|
| ***B65D 75/68*** | (2006.01) |
| ***B65D 75/20*** | (2006.01) |
| ***B65B 11/54*** | (2006.01) |
| ***B65B 25/00*** | (2006.01) |
| ***B65B 61/18*** | (2006.01) |
| ***B65D 75/66*** | (2006.01) |

(Continued)

(52) U.S. Cl.
CPC ..... *B65D 75/20* (2013.01); *B65B 11/48* (2013.01); *B65B 11/54* (2013.01); *B65B 25/005* (2013.01); *B65B 51/10* (2013.01); *B65B 61/065* (2013.01); *B65B 61/182* (2013.01); *B65B 69/00* (2013.01); *B65D 75/5827* (2013.01); *B65D 75/66* (2013.01); *B65D 85/60* (2013.01)

(58) Field of Classification Search
CPC ..... B65D 75/68; B65D 43/0222; B65D 77/2024; B65D 85/60; B65B 11/50; B65B 25/005
USPC ..... 206/266
See application file for complete search history.

(56) References Cited

U.S. PATENT DOCUMENTS

| | | | |
|---|---|---|---|
| 2,554,160 | A | 5/1951 | Von Gunten |
| 3,098,601 | A | 7/1963 | Anderson et al. |

(Continued)

FOREIGN PATENT DOCUMENTS

| | | | |
|---|---|---|---|
| DE | 32 47 958 | A1 | 6/1984 |
| GB | 666 323 | A | 2/1952 |
| GB | 804 559 | A | 11/1958 |

*Primary Examiner* — King M Chu
(74) *Attorney, Agent, or Firm* — Rothwell, Figg, Ernst & Manbeck, P.C.

(57) ABSTRACT

Described herein is a wrapper (1) for food products, in particular confectionary products, comprising—a wrapping sheet shaped so as to define a curved portion (2) within which a product is housed;—a tear strip (6) applied on an inner side of said sheet, and—an adhesive label (16) applied on the outer side of said curved portion (2) and on one end of said tear strip (6). The adhesive label (16) provides hermetic closing of the wrapper which is provided with a cut (12) at said one end of the tear strip (6) and at the same time comes to constitute, together with the tear strip (6) the means for opening the wrapper.

11 Claims, 6 Drawing Sheets

(51) Int. Cl.

| | |
|---|---|
| ***B65D 85/60*** | (2006.01) |
| ***B65B 51/10*** | (2006.01) |
| ***B65B 61/06*** | (2006.01) |
| ***B65B 69/00*** | (2006.01) |
| ***B65B 11/48*** | (2006.01) |
| ***B65D 75/58*** | (2006.01) |

(56) References Cited

U.S. PATENT DOCUMENTS

| | | | | |
|---|---|---|---|---|
| 3,311,032 | A | 3/1967 | Lucas | |
| 3,362,617 | A | 1/1968 | Gieber | |
| 4,651,874 | A | 3/1987 | Nakamura | |
| 5,704,481 | A | 1/1998 | Lutz | |
| 5,858,428 | A * | 1/1999 | Truscello ..... | A23G 1/502 426/103 |
| 2005/0167293 | A1 | 8/2005 | McBride | |
| 2008/0199570 | A1 | 8/2008 | Milano | |
| 2010/0209551 | A1 | 8/2010 | Mitra-Shah | |

* cited by examiner

WRAPPER FOR CONFECTIONARY PRODUCTS

CROSS REFERENCE TO RELATED APPLICATION

This application is a 35 U.S.C. 371 National Phase Entry Application from PCT/IB2016/052304, filed Apr. 22, 2016, which claims the benefit of Italian Patent Application No. 102015000013414 filed on Apr. 28, 2015, the disclosures of which are incorporated herein in their entirety by reference.

FIELD OF THE INVENTION AND PRIOR ART

The present invention relates to techniques for packaging and wrapping food products and has been developed with particular reference to wrapping of confectionary products.

In the field of wrapping of confectionary products, in particular wrapping of pralines, there are already known hermetically sealed wrappers constituted by two wrapping sheets coupled and sealed together so as to enclose the product inside them.

Solutions of this type are described in the patent documents Nos. EP0591742A1, EP1046579B1, EP0790184A1, EP2222567, filed in the name of the present applicant. These solutions have been developed by the present applicant specifically for wrapping the well-known pralines sold under the commercial name of Ferrero Rocher®.

In this field, there is a constant need to improve existing wrappers from the structural and functional standpoint, in the perspective, on the one hand, of reducing production costs and, on the other hand, of improving preservation of the product, and facilitating and simplifying opening the wrapper by the consumer to enable access thereto.

Moreover, in the field of wrapping of confectionary products there also exists the need to provide wrappers that are characterized by a particularly attractive aesthetic appearance, with the intent to recall the appearance of a home-made product and wrapper.

The aesthetic character of the wrapper can even assume a role of identification of the product, so that the consumer is able to recognise immediately the product simply on the basis of some of the aesthetic characteristics of the wrapper. In this regard, there may here be mentioned the gilt wrapper or the adhesive label bearing the commercial name of the product, used in wrapping of the Ferrero Rocher® pralines.

It is hence clear that in these cases any possible technical innovations must, however, be integrated in the structure of the wrapper, without altering—at least not beyond certain limits—its aesthetic character, which is immediately recognisable by the consumer.

OBJECT AND SUMMARY OF THE INVENTION

In the context outlined above, the object of the present invention is to provide a new wrapper for confectionary products that will be improved from various points of view as compared to the known solutions mentioned above, in particular from the standpoints of simplicity of the structure and of the ease and convenience with which it is possible to open the wrapper and gain access to the product, and at the same time that will be able to maintain some characteristic elements of the known wrappers referred to above.

The characteristics of the wrapper described herein are recalled in the ensuing claims. The present invention also relates to a process according to claim 9.

BRIEF DESCRIPTION OF THE DRAWINGS

Further characteristics and advantages of the invention will emerge clearly from the ensuing description with reference to the annexed drawings, which are provided purely by way of non-limiting example and in which.

DETAILED DESCRIPTION OF THE INVENTION

In the ensuing description various specific details are illustrated aimed at providing an in-depth understanding of the embodiments. The embodiments may be obtained without one or more specific details, or with other methods, components, materials, etc. In other cases, known structures, materials, or operations have been described in detail so that various aspects of the embodiments will not be obscured.

The references used herein are provided only for convenience and hence do not define the sphere of protection of the embodiments.

As mentioned at the start, the wrapper described herein is aimed at a use in the foodstuff field, in particular for wrapping confectionary products, preferably pralines. Reference to this sphere of application should not, however, be interpreted in a limiting sense, and the principles that will be described in what follows may likewise be used for food products of another type.

The figures illustrate a possible embodiment of the wrapper described herein, designated by the reference number 1.

Figure 2A:
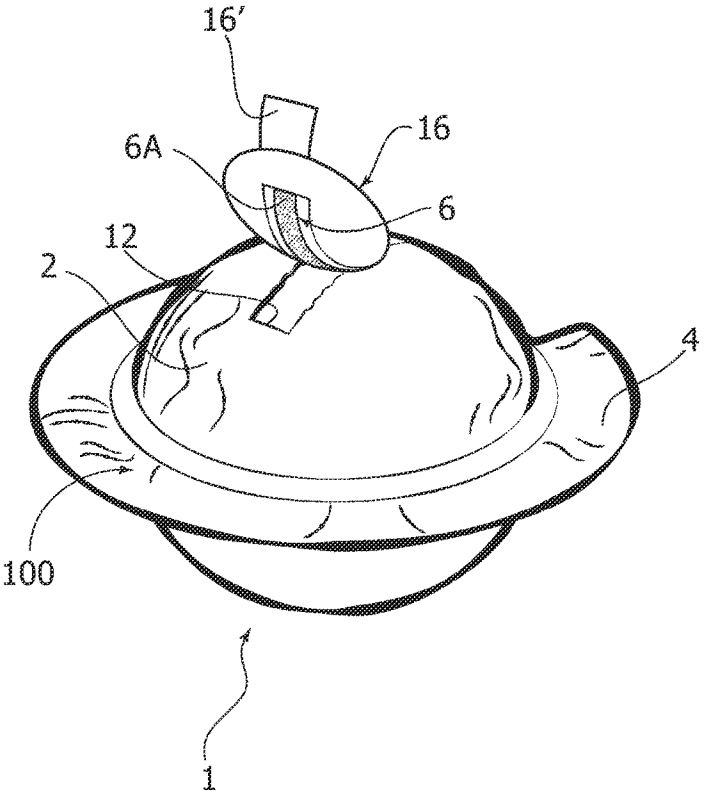
FIGS. 2*a*, 2*b*, 2*c* and 2*d* illustrate different steps of the operation of opening of the wrapper of FIG. 1.
Figure 1:
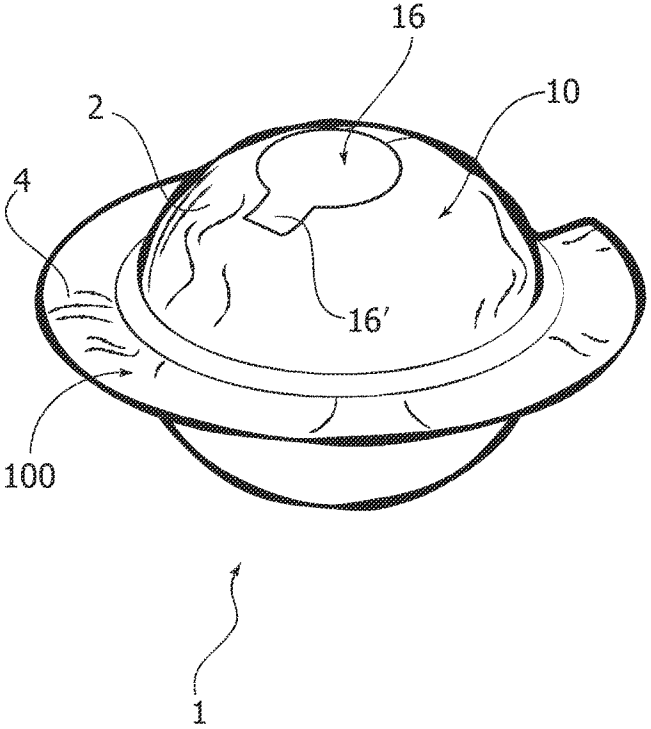
FIG. 1 illustrates an embodiment of the wrapper described herein, according to a perspective view.

With particular reference to FIG. 1, in general the wrapper described herein comprises a wrapping sheet 10 folded on itself so as to define a curved portion 2, received within which is a product P, and a peripheral portion 4, along which a sealing line 100 is made that hermetically closes the curved portion 2 with respect to the outside.

The sealing line 100 is defined by areas of the sheet 10 set on top of and in contact with one another, which are to adhere to one another as a result of a sealing operation.

The sheet 10 may be made of any material commonly used in the technical field of interest. By way of example, there may be mentioned: i) aluminium foils, preferably coated with thermo-adhesive material, for example polyethylene, polypropylene, etc.; ii) sheets of plastic material, possibly laminated, for example with a base of propylene, polythene, polypropylene, polyester, polyethylene, polileptide, polyamide, etc.; or else iii) coupled sheets, obtained by various combinations of paper, paperboard, aluminium, and plastic materials of various nature including the plastic materials referred to above. The sealing material may also be a cold-sealing material.

As will be mentioned also in what follows, the type of operation with which the sealing line 100 is obtained may vary according to the composition of the sheet 10.

Figure 2C:
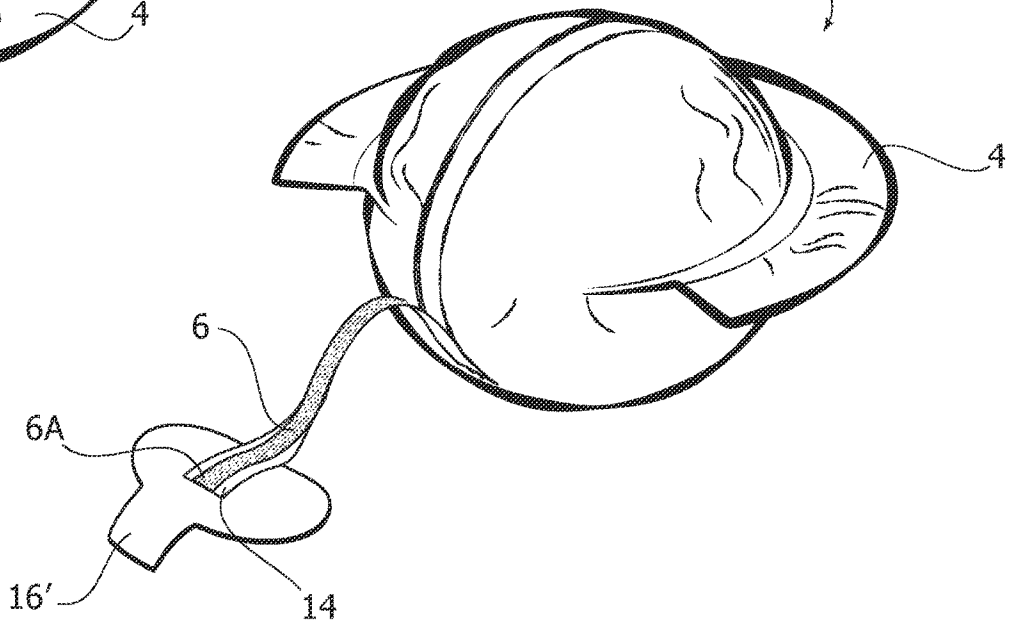
Figure 2B:
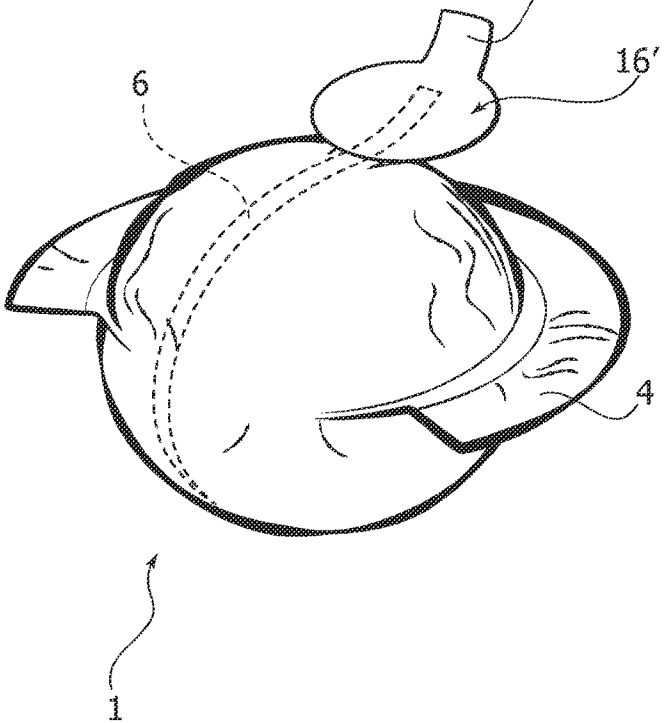
Figure 2D:
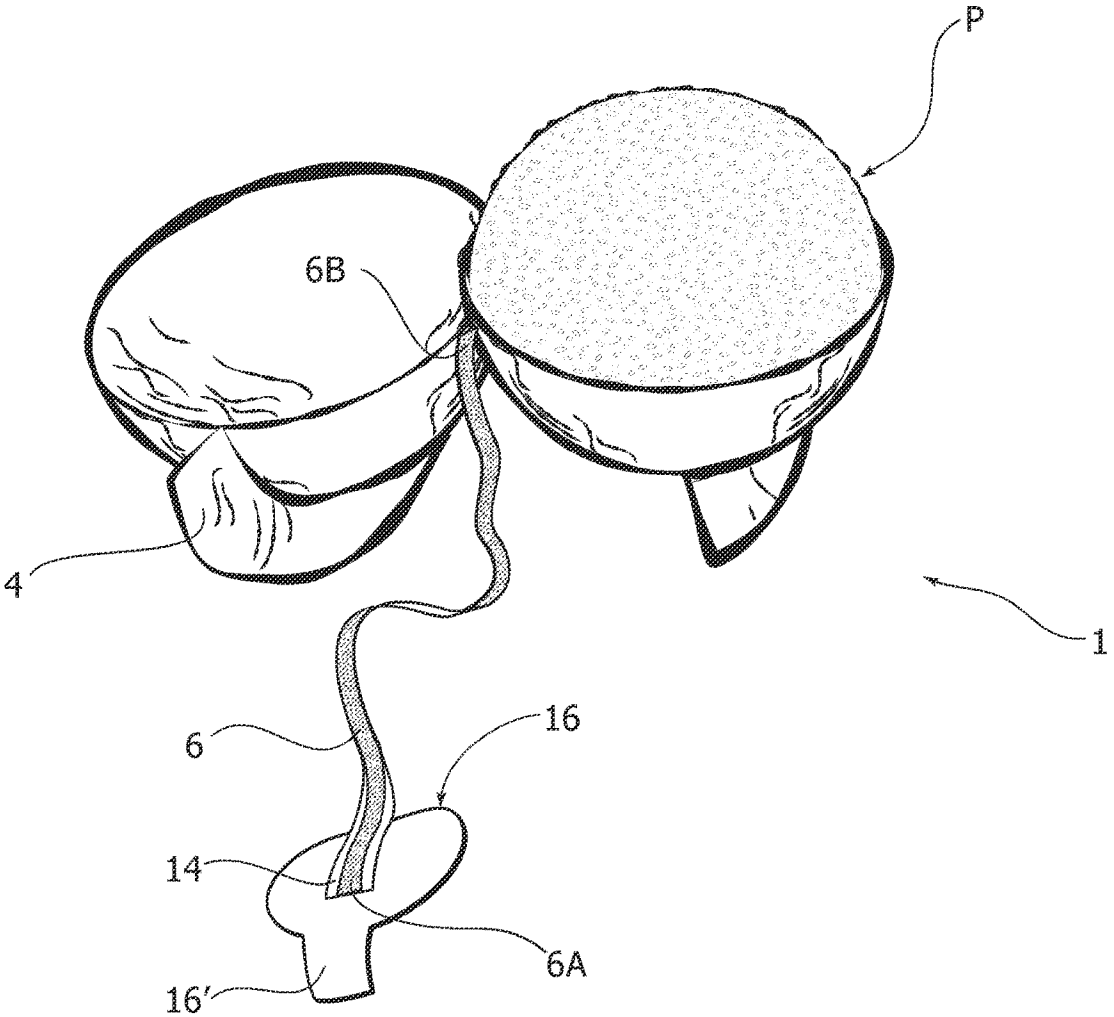

The wrapper described herein moreover comprises a tear strip 6 applied on the inner side of the sheet 10, which traverses at least one part of the curved portion and has one end thereof—in the figures the end designated by the reference 6*a*—located in the curved portion itself. In various embodiments, as in the one illustrated, the opposite end of the tear strip—designated in the figures by the reference 6*b*—is, instead, located in the peripheral portion 4 (see FIG. 2D).

As is in itself already known in the art, the tear strip 6 constitutes an element designed to facilitate tearing of the wrapper at the moment when it is opened, and, in particular, identifies, with its own orientation, the direction along which the wrapper is torn.

In various preferred embodiments, such as the one illustrated, the tear strip 6 traverses the curved portion 2 following a path contained in an ideal middle plane; this enables division of the wrapper, as a result of tearing, substantially into two half-shells so that one of these can be used by the consumer for holding the product without putting his or her hands directly in contact therewith.

The sheet 10 has a cut 12 associated to the end 6*a* of the tear strip, which defines a point for triggering tearing of the wrapper. In various preferred embodiments, the cut 12 is defined by a profile such as to identify on the sheet 10 a tab 14 having a width equal to or greater than that of the tear strip, to which the end 6*a* of the tear strip itself adheres. In various embodiments, as in the one illustrated, the cut 12 is defined by a U-shaped broken-line profile.

Tearing of the wrapper hence starts from the cut and then extends in the direction defined by the tear strip 6.

The wrapper described herein moreover comprises an adhesive label 16, which is applied directly on the cut 12 and has a dual function. A first function is that of ensuring hermetic closing of the wrapper: this is in fact obtained on the one hand thanks to the sealing line 100 and, on the other, via the label 16 itself, which is applied on the cut 12 so as to close any fluid communication through the latter between the inside and the outside of the wrapper. For this purpose, the label 16 adheres both to the tab 14 and to the surrounding part of the sheet 10.

The second function of the label 16 is, instead, that of constituting, together with the tear strip 6 and the cut 12, the means for opening the wrapper, via which the consumer can tear in a controlled way the sheet 10 of wrapping and gain access to the product.

The label 16 is in particular designed so that it can be separated from the sheet 10 and at the same time can draw along with it the tab 14 and the tear strip 6 attached thereto.

In various preferred embodiments, the inner face of the label 16 is coated with an adhesive material of the so-called removable type, designed in particular to determine a force of adhesion that, on the one hand, is sufficiently low as to enable the consumer to detach the label from the portion of the sheet 10 surrounding the tab 14, but that, on the other hand, is in any case greater than or equal to a minimum threshold capable of ensuring effective adhesion of the label to the sheet to obtain hermetic closing of the cut 12, and guarantee that the tab 14 and the tear strip associated thereto can remain adherent to the label when this is detached from the sheet. In alternative embodiments, the inner side of the label 16 may, instead, present at least two different types of adhesive material, a first type in an area of the label that is to come into contact with the tab 14 and a second in an area of the label that is to come into contact with the region of the sheet 10 around the tab 14. In this case, the first adhesive material will be designed to determine a force of adhesion sufficiently low as to enable the consumer to detach the label from the sheet 10 and to guarantee at the same time the aforesaid minimum force of adhesion, whereas the second adhesive material may determine a greater force of adhesion, even far greater, to ensure anchorage between the label and the tab 14.

In various preferred embodiments, the label 16 is made of plastic material, for example polypropylene, and is coated, on its inner surface, with adhesive glue, for example of the type used on self-adhesive labels, appropriately selected to determine the degree of adhesion referred to above. The label could, however, also be made of paper material or other types of material. The action of separation of the label from the sheet 10 evidently causes start of tearing of the sheet starting from the cut 12 and, consequently, progressive removal of the tear strip 6 from the product P, which in turn induces a progression of the tearing action along the tear strip.

In various preferred embodiments like the one illustrated, the adhesive label 16 has a peripheral portion 16' that is not adhesivized, i.e., the inner side of which does not have adhesive material, that is designed to constitute a preferential gripping portion for enabling gripping of the label by the consumer. In various even more preferred embodiments, such as the one illustrated, the portion 16' has the form of a tab.

The label described may clearly have any shape and reproduce, on its outer face, graphic elements of various nature, and for those applications in which wrappers provided with labels are already used (consider, for example, the product Ferrero Rocher® mentioned at the start), the adhesive label may advantageously present an appearance altogether resembling that of the labels of the aforesaid known wrappers, the aim being to meet the need mentioned at the start of maintaining, also in the new wrappers, that "traditional" aesthetic character that is immediately recognisable by the consumer.

FIG. 2 illustrates a sequence of the operation of opening of the wrapper.

As emerges from FIG. 2, in the embodiment illustrated tearing involves a preponderant part of the curved portion. This affords the advantage of rendering the product readily accessible through the openings formed in the wrapping as a result of tearing, and, as mentioned above, also the advantage of dividing the wrapper into two half-shells so that one of these can be used for holding the product in one's hand (see FIG. 2D).

In the light of what has been said above, it is evident that the configuration described enables the following results to be obtained:

- total hermetic closing of the wrapper;
- provision of means for facilitated opening of the wrapper located exactly in the curved portion, where the product is immediately accessible; and
- an optimal aesthetic result, thanks to the fact the adhesive label is itself used as means for opening the wrapper, the label being perfectly integrated in the general appearance of the product and among other things, as has been seen, is already envisaged—albeit only as ornamental element—in some known wrappers widely available on the market.

With reference to FIGS. 3A-3F, the process for providing the wrapper described above will now be illustrated hereinafter.

The process in question is characterized in that an appropriately prepared wrapping sheet is used—designated in FIGS. 3A-3F by the same reference 10 as the one used for the wrapping sheet of the wrapper of FIGS. 1 and 2A-2C—which preferably has the following configuration:

- a thin tape 106 applied on the inner side of the sheet, which, as will be mentioned hereinafter will come to provide the tear strip 6, and which extends in a main direction of the sheet and connects two opposite edges of the latter;

a cut 112 made in a region of said sheet comprised between the aforesaid opposite edges, which involves said tape and said sheet and identifies the cut 12, the tear strip 6, the end 6A, and the tab 14, described above with reference to FIGS. 1 and 2A-C; and the label 16 applied on the outer side of the sheet in a position corresponding to the cut 112.

In various embodiments, the sheet in question can be directly obtained during the wrapping process, via a series of preliminary steps—not illustrated in the figures—in which:

a continuous sheet of wrapping is wound off a reel;

in a first station, on the inner side of the sheet a continuous adhesive tape is applied, which is also wound off a reel, this tape corresponding to the tape 106 mentioned above;

in a second station, the sheet and the tape coupled thereto are subjected to a cutting operation to obtain the aforesaid cut 112;

in a third station, on the outer side of the sheet, the label 16 is applied on the cut 112, for hermetic sealing of the area of the sheet containing the cut; and in a fourth station, the sheet with the tape coupled thereto is subjected to a cutting operation in which it is divided into single sheets, each characterized by the configuration outlined above.

Figures 3A, 3B:
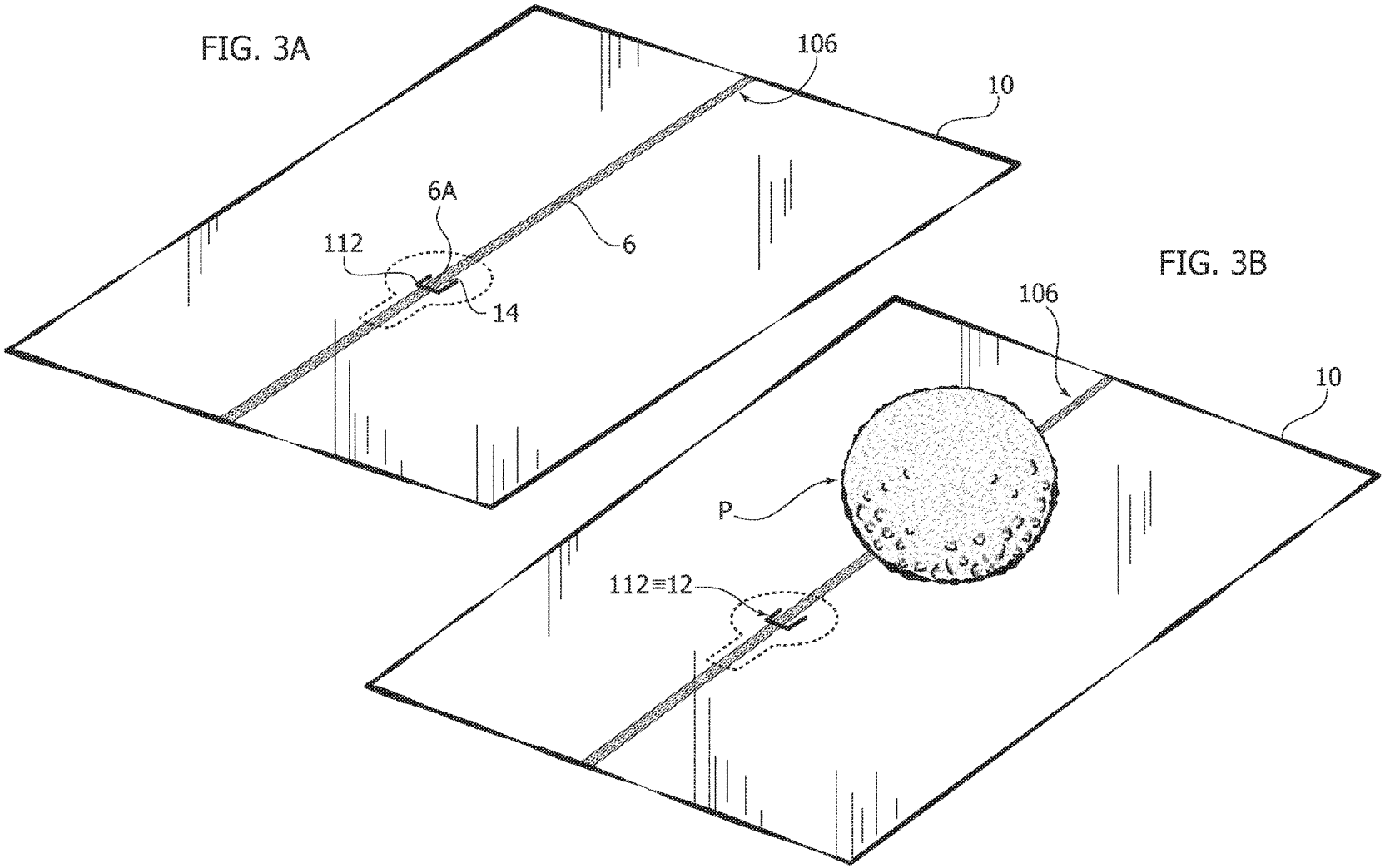
FIGS. 3A-3F illustrate successive steps of an embodiment of the process described herein.
Figure 3C:
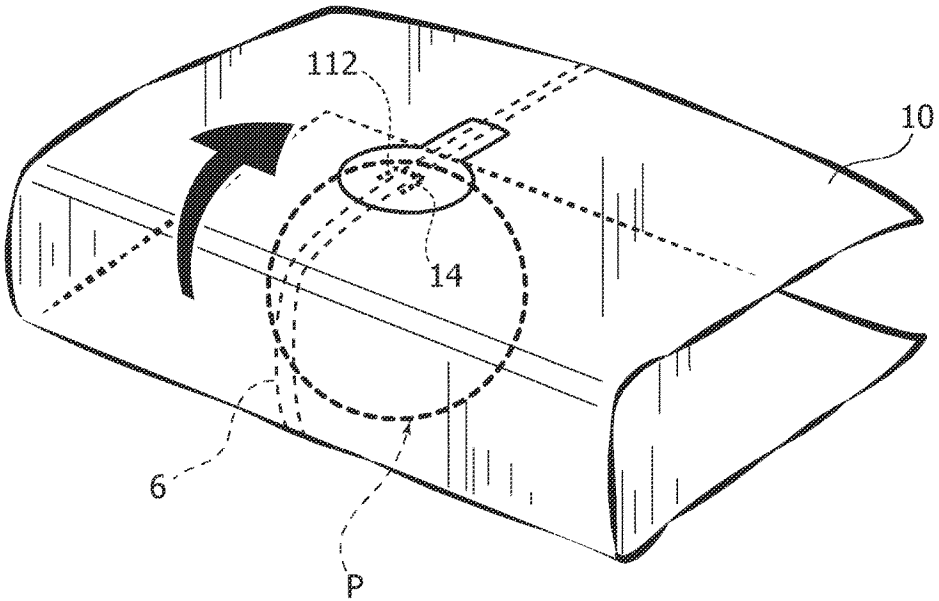
Figure 3D:
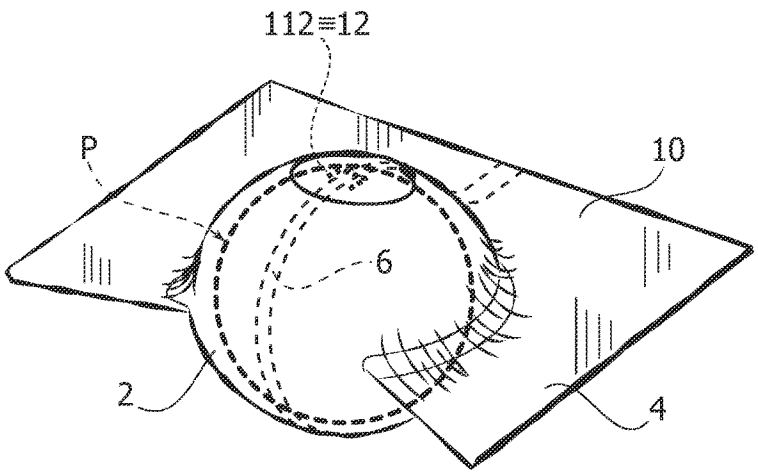
Figure 3E:
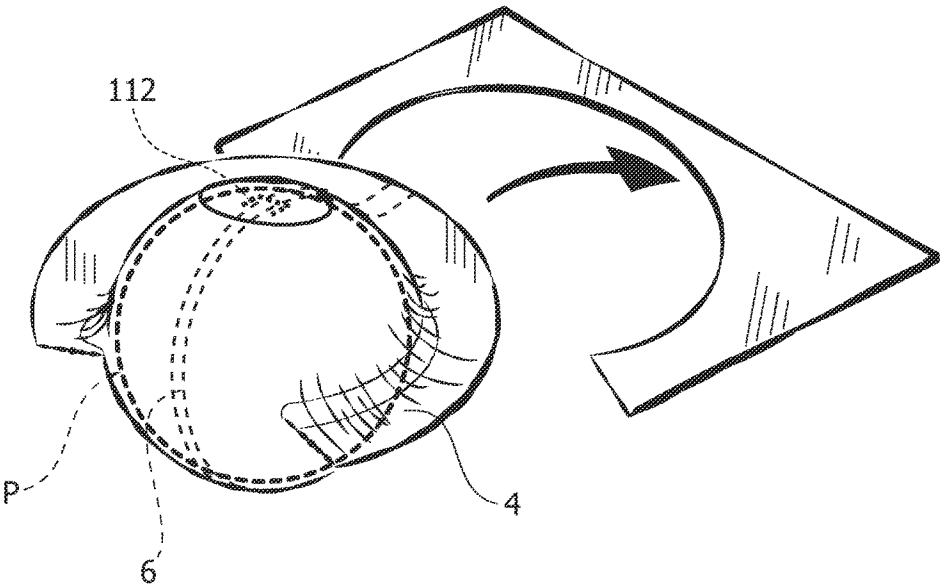
Figure 3F:
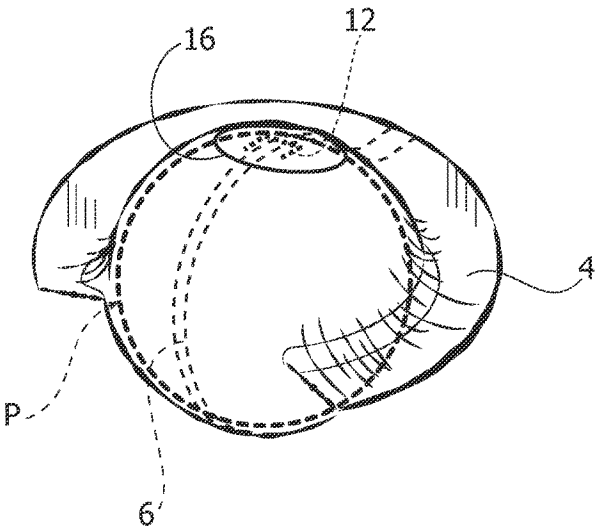

Starting from the single sheet having the configuration described (FIG. 3A), the process hence envisages laying the product on the sheet 10 (FIG. 3B), on the inner side where the tape 106 is applied, and wrapping the sheet around the product until the aforesaid curved portion 2 and peripheral portion 4 are obtained (FIG. 3D). In various embodiments, such as the one illustrated, the sheet 10 is folded on itself along a curving line set transverse with respect to the direction identified by the tape 106.

Following upon the operation of wrapping of the sheet 10 on the product, the cut 112 and the label 16 come to be located on the curved portion 2, preferably in a central region thereof, at a given distance from the peripheral portion 4. The process then envisages making the sealing line 100 on the peripheral portion 4 (FIG. 3D). This sealing operation can be obtained according to different modalities, obviously taking into account the type of material that constitutes the wrapping sheet, in particular its inner side. For example, in the case where the inner side of the sheet is coated with plastic material or in any case is defined by a layer made of plastic material, the sealing line 100 may be obtained via a heat-sealing operation. If the sheet is constituted by an aluminium foil, it may instead be necessary to use glues, of a hot type or a cold type according to the requirements of the specific applications. It is clear that the use of glues may be envisaged also in the cases where the inner side of the sheet is made of plastic material.

After formation of the sealing line 100, in various embodiments, such as the one illustrated, the process envisages an operation of cutting or dinking of the peripheral portion 4 formed, to define on said portion a shaped outer edge (FIG. 3E); in the example of embodiment of the figures, this edge has a substantially semicircular profile.

It should be noted that application of the label 16 on the sheet even before this is wrapped on the product presents the advantage, on the one hand, of facilitating application of the label since there is no risk of damaging the product, and, on the other hand, of guaranteeing effective adhesion between the label and the sheet thanks to the fact that in this way there is prevented the problem of any possible creases interfering in the adhesion process that may form on the sheet as a result of it being wrapped round the product.

It should further be noted that, thanks to the particular positioning of the point for triggering of tearing and of the corresponding end of the tear strip in the central region of the curved portion 2, and to the fact that the gripping point of the tear strip is defined by the label 16 itself, the wrapper described herein is characterized by enabling extremely convenient and perfectly controlled opening. Facilitated opening is moreover favoured by the fact that the material to be torn is constituted by just one layer of the sheet 10, which would not be possible in the case where the point for triggering tearing were positioned at the sealing edge 4, where the sheet 10 is in fact laid on top of itself.

Of course, without prejudice to the principle of the invention, the details of construction and the embodiments may vary, even significantly, with respect to what has been illustrated herein purely by way of non-limiting example, without thereby departing from the scope of the invention, as defined by the annexed claims.

The invention claimed is:

1. A wrapper for food products, in particular confectionary products, comprising:

a wrapping sheet (10) shaped so as to define a curved portion (2) within which a product (P) is housed;

an adhesive label (16) applied on the outer side of said curved portion (2);

said wrapper being characterized in that:

said sheet is folded on itself so as to define said curved portion (2) and a peripheral portion (4) along which a sealing line (100) is made, and in that it comprises a tear strip (6) applied on the inner side of said sheet so as to traverse at least one part of said curved portion, wherein at least one end (6A) of said tear strip is set in said curved portion (2), at a given distance from said peripheral portion (4);

wherein said sheet has at least one cut (12) made in a position corresponding to said end of said tear strip, which is designed to define a point for triggering tearing of said sheet; and wherein said adhesive label (16) is applied on said cut (12) so as to close any communication through it between the inside and the outside of said curved portion (2).

2. The wrapper according to claim 1, wherein said cut has a profile such as to identify on said sheet a tab (14) to which said end (6*a*) of said tear strip (6) adheres.

3. The wrapper according to claim 2, wherein said adhesive label applied on said cut adheres to said tab (14) and to a region of said sheet surrounding said tab (14).

4. The wrapper according to claim 3, wherein the inner face of said label (16) is coated with an adhesive material designed to determine a force of adhesion that is such as to enable removal of said label from said sheet by the consumer, and to cause said tab (14) to remain adherent to said label (16) when the latter is separated from said sheet.

5. The wrapper according to claim 1, wherein said tear strip (6) is applied on said sheet according to an orientation such that said strip traverses said curved portion (2) following a path contained in an ideal middle plane.

6. The wrapper according to claim 1, wherein said label (16) applied on said sheet has an extension that is such as to contain the entire development of said cut (12) and, preferably, is at the same time limited to a region of said sheet surrounding said cut (12).

7. The wrapper according to claim 1, wherein said label (16) comprises a peripheral portion (16'), the inner side of which does not have adhesive material and which is designed to constitute a preferential gripping portion for enabling gripping of said label by the consumer.

8. The wrapper according to claim 1, wherein said sealing line (100) is constituted by areas of said curved sheet that are set on top of, and in contact with, one another, which are connected together as a result of a sealing operation.

9. A process for making a wrapper according to claim 1, comprising the steps of:

providing a wrapping sheet (10);

wrapping said wrapping sheet around the product so as to define said curved portion (2) and said peripheral portion (4); and providing said sealing line (100) on said peripheral portion (4);

wherein the step of providing said wrapping sheet envisages providing said sheet in which:

said tear strip is applied on the inner side of said sheet and extends in a main direction of said sheet;

said cut (12) is made at said end (6A) of said tear strip (6); and said adhesive label (16) is applied on the outer side of said sheet in a position corresponding to said cut (12).

10. The process according to claim 9, wherein the step of wrapping said product in said sheet envisages folding said sheet along a fold axis transverse to said main direction of said sheet.

11. The process according to claim 9, wherein said step of providing said wrapping sheet comprises the steps of:

providing said wrapping sheet (10) wherein on its inner side is applied a tape (106) that extends in a main direction of said sheet and connects two opposite edges of said sheet;

carrying out a cutting operation in a region of said sheet comprised between said opposite edges, wherein said cutting operation envisages cutting in a single action said sheet and said tape applied on said sheet, so as to identify said cut (112, 12) and said tear strip (6) provided with said end (6*a*) that is to come to occupy a position corresponding to said curved portion (2) of said wrapper; and applying said adhesive label (16) on the outer side of said sheet in a position corresponding to said cut (12).

* * * * *